US008322427B2

(12) United States Patent
Inderberg et al.

(10) Patent No.: US 8,322,427 B2
(45) Date of Patent: Dec. 4, 2012

(54) CONTROL SYSTEM

(75) Inventors: Olav Inderberg, Kongsberg (NO); John A. Johansen, Kongsberg (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 422 days.

(21) Appl. No.: 11/954,984

(22) Filed: Dec. 12, 2007

(65) Prior Publication Data

US 2008/0296025 A1 Dec. 4, 2008

(51) Int. Cl.
*E21B 47/00* (2012.01)

(52) U.S. Cl. .... 166/336; 166/344; 166/368; 166/250.01

(58) Field of Classification Search ..... 166/337, 166/336, 338, 339, 368, 250.01, 250.08
See application file for complete search history.

(56) References Cited

U.S. PATENT DOCUMENTS

| | | | | | |
|---|---|---|---|---|---|
| 2,670,225 | A | | 2/1954 | McKinney | 286/16 |
| 3,638,722 | A | | 2/1972 | Talley, Jr. | 166/0.5 |
| 3,712,862 | A | | 1/1973 | Bundrant et al. | 252/8.55 |
| 4,105,075 | A | * | 8/1978 | Helmus | 166/321 |
| 4,130,161 | A | * | 12/1978 | Jones | 166/337 |
| 4,658,904 | A | | 4/1987 | Doremus et al. | 166/336 |
| 4,705,114 | A | | 11/1987 | Schroeder et al. | 166/357 |
| 4,836,289 | A | | 6/1989 | Young | 166/379 |
| 4,880,060 | A | * | 11/1989 | Schwendemann et al. | 166/336 |
| 4,993,492 | A | | 2/1991 | Cressey et al. | 166/339 |
| 5,238,070 | A | * | 8/1993 | Schultz et al. | 166/386 |
| 5,244,362 | A | | 9/1993 | Conally | 417/403 |
| 5,819,582 | A | | 10/1998 | Kelly | 73/290 R |
| 6,102,125 | A | | 8/2000 | Calder | 166/359 |
| 6,298,767 | B1 | | 10/2001 | Porter | 91/4 R |
| 6,360,822 | B1 | | 3/2002 | Robertson | 166/368 |
| 6,595,287 | B2 | | 7/2003 | Fisher | 166/250.15 |
| 6,736,012 | B1 | * | 5/2004 | Beall et al. | 73/709 |
| 6,957,698 | B2 | | 10/2005 | Krueger et al. | 166/116 |
| 7,096,975 | B2 | * | 8/2006 | Aronstam et al. | 175/25 |
| 7,114,581 | B2 | * | 10/2006 | Aronstam et al. | 175/57 |
| 7,174,975 | B2 | * | 2/2007 | Krueger et al. | 175/57 |

(Continued)

FOREIGN PATENT DOCUMENTS

| | | |
|---|---|---|
| GB | 1 594 714 | 10/1977 |

(Continued)

*Primary Examiner* — Matthew Buck
(74) *Attorney, Agent, or Firm* — Williams, Morgan & Amerson, P.C.

(57) ABSTRACT

A method of reducing a pressure within a first cavity of a subsea device is disclosed which includes transferring fluid within the first cavity to an accumulator, increasing a pressure of the fluid within the accumulator and, after increasing the pressure of the fluid within the accumulator, transferring at least some of the fluid in the accumulator into a second cavity, wherein the second cavity is at a higher pressure than said first cavity. A device for reducing a pressure within a first cavity of a subsea device is also disclosed which includes a transfer accumulator comprising a piston, the transfer accumulator being in fluid communication with the first cavity and a second cavity, at least one first valve positioned between the first cavity and the transfer accumulator, the at least one first valve adapted to permit fluid flow only from the first cavity to the second cavity, and at least one second valve positioned between the transfer accumulator and the second cavity, the at least one second valve adapted to permit fluid flow only from the transfer accumulator to the second cavity.

15 Claims, 5 Drawing Sheets

U.S. PATENT DOCUMENTS

| | | | | |
|---|---|---|---|---|
| 7,191,830 | B2 * | 3/2007 | McVay et al. | 166/242.1 |
| 7,331,393 | B1 * | 2/2008 | Hoel | 166/336 |
| 7,520,129 | B2 * | 4/2009 | Springett | 60/398 |
| 7,793,725 | B2 * | 9/2010 | Daniel et al. | 166/366 |
| 7,798,233 | B2 * | 9/2010 | Daniel et al. | 166/363 |
| 7,836,973 | B2 * | 11/2010 | Belcher et al. | 175/25 |
| 7,926,501 | B2 * | 4/2011 | Springett et al. | 137/14 |
| 7,938,189 | B2 * | 5/2011 | Rytlewski | 166/337 |
| 2005/0178560 | A1 * | 8/2005 | Johansen et al. | 166/374 |
| 2006/0117838 | A1 * | 6/2006 | Williams | 73/46 |

FOREIGN PATENT DOCUMENTS

| | | | |
|---|---|---|---|
| GB | 2 184 762 | A | 12/1986 |
| GB | 2 214 954 | A | 11/1988 |
| GB | 2 233 365 | A | 6/1990 |
| WO | WO 93/03254 | | 2/1993 |
| WO | WO 01/25593 | A1 | 4/2001 |

* cited by examiner

CONTROL SYSTEM

BACKGROUND OF THE INVENTION

1. Field of the Invention

The present subject matter is directed to a method and device for relieving a pressure within a first cavity to a second cavity in a subsea facility.

2. Description of the Related Art

There are several wireline and well control functions that require occasional pressure testing and/or pressure build-up monitoring to assure that barriers and seals are functioning properly during installation and workover operations. Typically, this involves a test line conduit that can either supply pressurized fluids to the testing location or allow the venting and removal of fluids for leak detection. However, operations associated with light well intervention (RLWI) often adopt a philosophy of "no hydrocarbons to surface." In other words, the conduit between the test location and the pressure/monitor source is no longer present due to the possibility of wellbore fluids (hydrocarbons) traveling through the conduit to the pressure/monitor source on the vessel in proximity to personnel. If the conduit is present, more safety measures and higher vessel certification are required in order to properly handle and dispose of hydrocarbons should they become present. All of this, in turn, increases the day rate (charges per day) which would otherwise make RLWI less economical.

FIG. 1 is an exemplary schematic drawing showing an illustrative prior art RLWI system where the subject matter disclosed herein may be employed. As will be recognized by those skilled in the art after a complete reading of the present application, the system depicted in FIG. 1 is only an example, as the subject matter disclosed herein may be employed with any subsea system where such features are desirable.

FIG. 1 shows a subsea lubricator stack 10 for an intervention system attached to a subsea well 5 equipped with a Christmas tree 6 and a flowline/umbilical 7 extending to a process facility (not shown). The subsea lubricator stack 10 includes a pressure control device such as a Lower Riser Package (LRP) 11, a lubricator (pipe) 12 and the pressure control head (PCH) 13. The system has a control unit 15 for the control of the various processes during the operation. A special intervention umbilical 17 may be attached to the control unit 15. The umbilical 17 extends to a remote control station (not shown). The line 23 may carry electrical and/or optical signals and hydraulic lines for fluid communication between the control unit 15 and devices in the PCH 13. The lubricator stack 10 is used to insert tools into the well as is well known in the art.

The present invention is directed to methods and devices solving, or at least reducing the effects of, some or all of the aforementioned problems.

SUMMARY OF THE INVENTION

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

The proposed invention provides a means to create a differential pressure and redirect hydrocarbons back into the well; providing for both the pressure test mission and preventing hydrocarbons from escaping.

The present subject matter relates to a method for moving a fluid from a first cavity with a lower pressure, for instance an annulus, to a second cavity with a higher pressure, for instance a flow line, in a subsea facility. In one aspect disclosed herein, a fluid within the first cavity is allowed to flow through a first line to a transfer accumulator which fluid then is pressurized by a piston arrangement within the transfer accumulator and then transferred from the transfer accumulator into the second cavity. This process may either be used for building pressure within a cavity with a fluid from a cavity with a lower pressure than the pressure desired in the cavity or to release a fluid from a cavity with a fluid at a lower pressure to a fluid with a higher pressure.

BRIEF DESCRIPTION OF THE DRAWINGS

The invention may be understood by reference to the following description taken in conjunction with the accompanying drawings, in which like reference numerals identify like elements, and in which.

Figure 1:
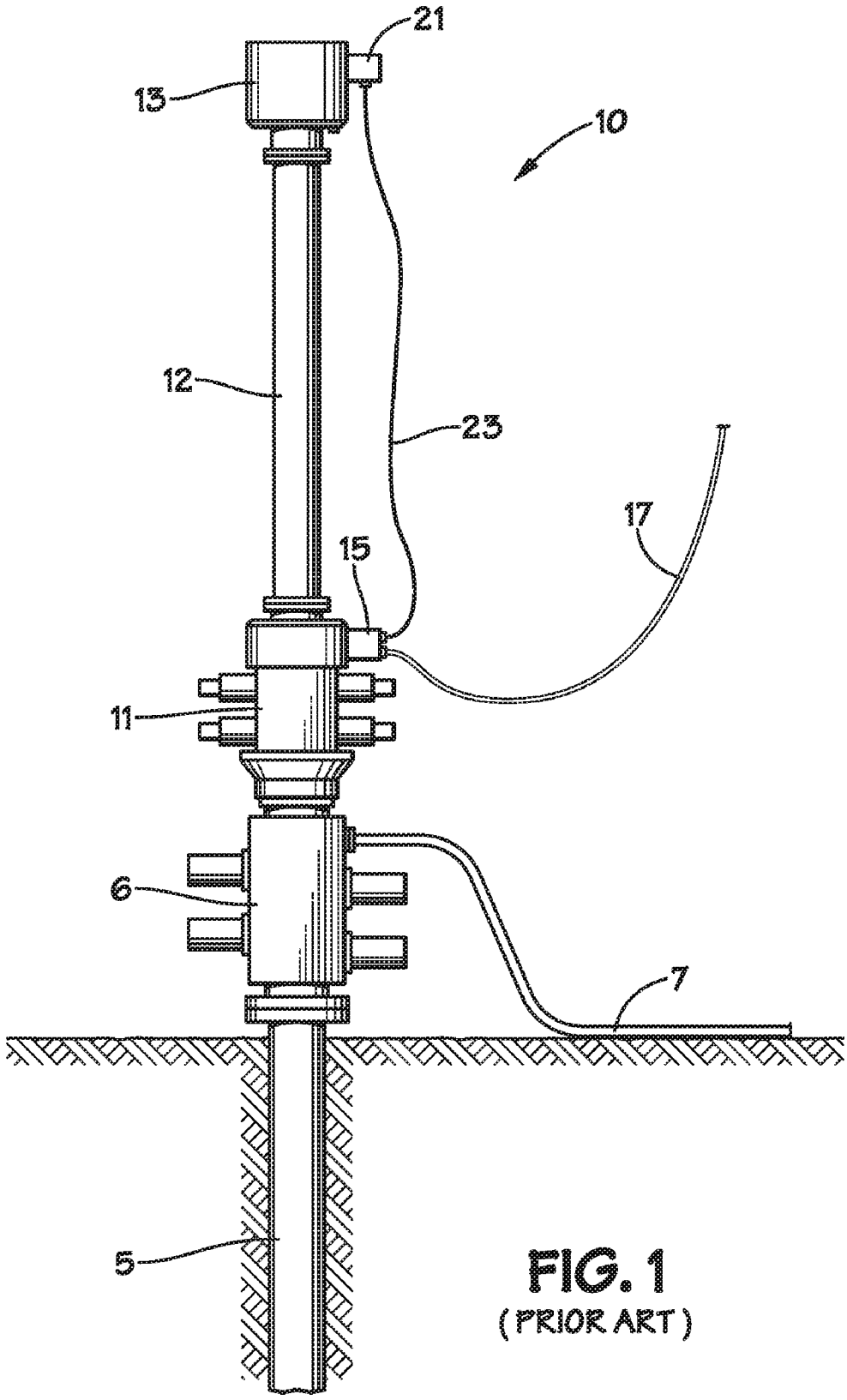
FIG. 1 (PRIOR ART)
FIG. 1 is a sketch of an illustrative prior art intervention system on a subsea well.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the present subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

The control system components described herein may be made as part of the control unit 15 for the illustrative intervention system depicted in FIG. 1. However, as will be recognized by those skilled in the art after a complete reading of the present application, the components described herein may also be provided as a separate module located in the vicinity of the well. Moreover, as will be recognized by those skilled in the art after a complete reading of the present application, the system depicted in FIG. 1 is only an example where the present invention may be employed, as the subject matter disclosed herein may be employed with any subsea system where such features are desirable. It is also contemplated that the systems disclosed herein may be completely autonomous systems, with the necessary signal and power requirements being met by using a production umbilical.

Figure 2:
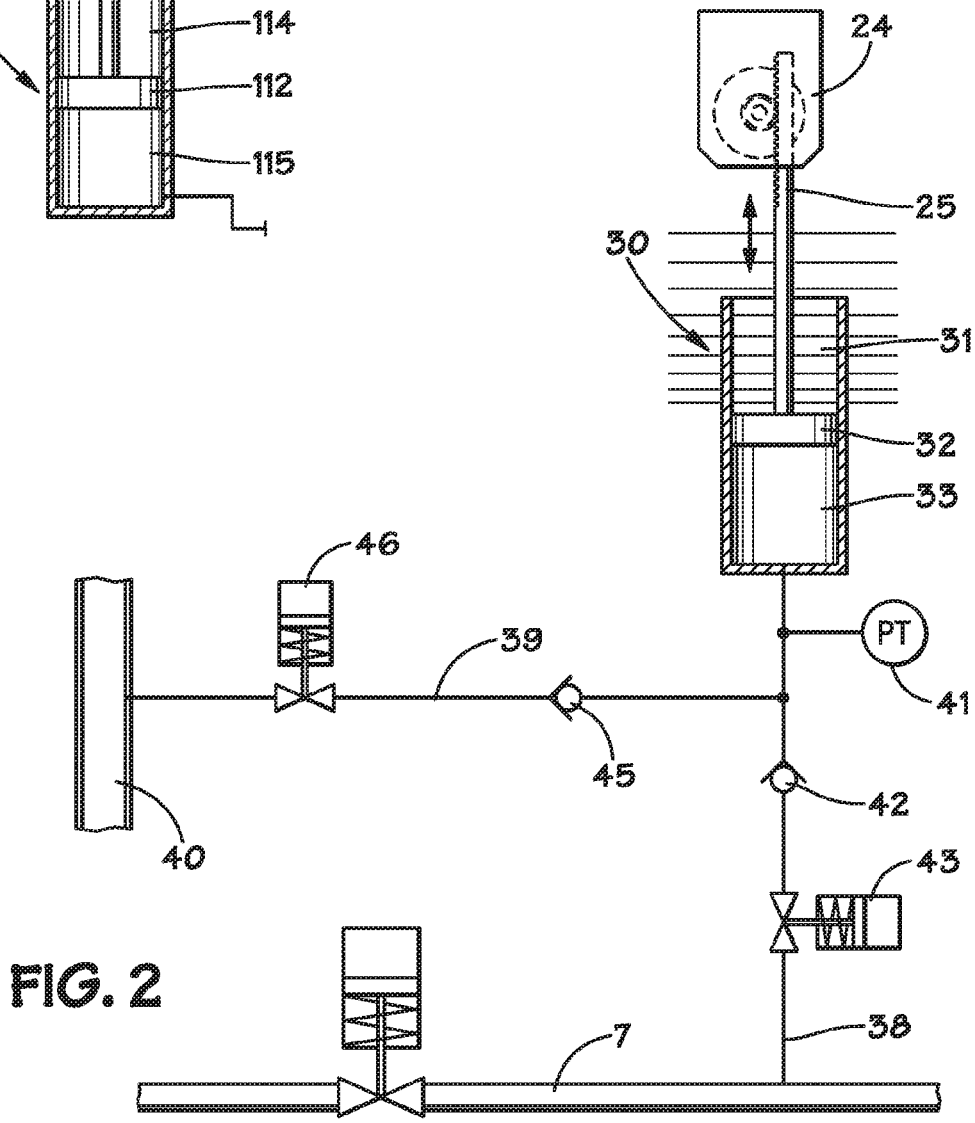
FIG. 2 is a schematic diagram showing one illustrative embodiment disclosed herein.

FIG. 2 shows a diagram of the principle for reducing the pressure of a cavity 40. The cavity 40 may be in the Christmas tree 6, for example, a crown plug cavity, in the LRP 11 or even in the PCH 13. A transfer accumulator 30 comprises a piston 32 that divides the accumulator into two chambers 31 and 33. In a first embodiment, the piston 32 is connected via a rod 25 to an electric motor 24 such that the motor can move the piston 32 in the accumulator 30. The chamber 31 may be open to the surrounding seawater while the chamber 33 has a first fluid connection with the flowline 7 by line 38. A one-way valve 42 and an actuated valve 43 are incorporated into the line 38. There is also a sensor 41 comprising a pressure and temperature transmitter. The chamber 33 has a second fluid connection with a cavity 40 via a line 39. A one-way valve 45 and an actuated valve 46 are incorporated in the line 39.

Figure 3:
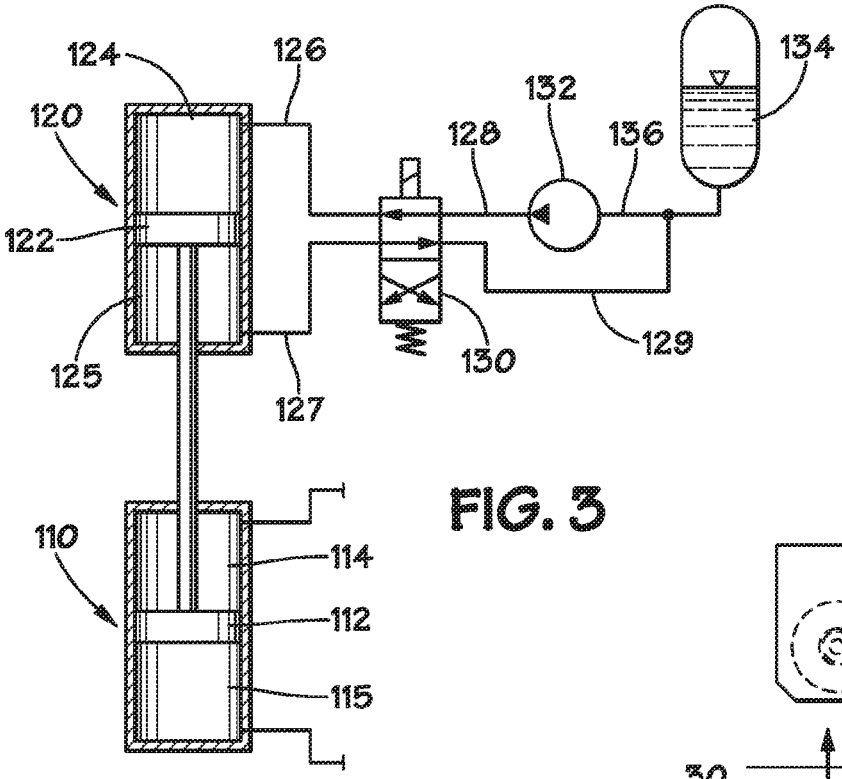
FIG. 3 is a sketch showing various details of another illustrative embodiment disclosed herein.

FIG. 3 depicts an alternate embodiment of means for actuating of the piston in the transfer accumulator. A first cylinder 110 comprises a movable piston 112 that divides the cylinder into two chambers 114 and 115. A second cylinder 120 likewise comprises a movable piston 122 that divides the cylinder into two chambers 124 and 125. A rod 118 connects the two pistons 112, 122 with each other so that they will move in tandem. The chamber 124 of the second cylinder 120 is connected via line 126 to a control valve 130. The other chamber 125 is also connected via line 127 to the control valve 130. On the other side of the control valve 130, a line 128 connects to the outlet of a pump 132. The pump inlet is connected via line 136 to an accumulator 134. Another line 129 is connected between the control valve 130 and directly to the accumulator 134. The function of line 129 is a return line while line 128 is the supply line.

With the control valve 130 in the position shown in FIG. 3, starting the pump 132 will pump hydraulic fluid into chamber 124, forcing piston 122 to move downwards. Fluid in chamber 125 empties via lines 127 and 129 back to the accumulator 134. To move piston 122 upwards, the control valve 130 is switched to its second position.

Cylinder 120 can be regarded as a master cylinder and cylinder 110 a slave cylinder. The area of pistons 122 and 112 may be different. For example, it may be advantageous to make the area of piston 112 smaller to minimize the "dead" volume in chamber 115.

It should be noted that chambers 33 and 115 are connected with pipes or voids that may contain gas. Since gas is a compressible medium, it is difficult to use a pump to operate directly in a gas environment for pressurizing or evacuation. The arrangement will, as stated above, also make it possible to have different areas of the pistons. This feature enables the unit to be easily adapted to different circumstances, e.g., different gas fractions.

Referring again to FIG. 2, the function of the device will now be described. When piston 32 is moved upwards, this will reduce the pressure in cavity 40. One-way valve 42 will prevent fluid from being drawn up from the flowline 7. When the movement of the piston 32 is reversed, it will increase the pressure in line 38, thereby moving the fluid in chamber 33 into the flowline 7. The one-way valve 45 will stop fluid moving into line 39. The piston 32 is cycled as many times as necessary to reduce the pressure in the cavity 40 to the desired level. The pressure sensor 41 records the pressure reached in each cycle.

This arrangement enables pressure to be reduced to a lower level than the ambient pressure. The only limitation for how far the pressure in the cavity 40 can be reduced is the "dead volume" in the accumulator 30.

If the cavity 40 is behind a seal (not shown) to be tested for integrity, the pressure in the cavity 40 is reduced to a level where the pressure difference across the seal will be large enough to verify that the seal functions normally.

If the cavity 40 for some reason has been clogged up with a hydrate plug, reducing pressure in the cavity 40 will enable the hydrate to "boil" off, thereby removing the plug. In one embodiment, the pressure in the cavity 40 may be continuously recorded. When the pressure has reached a level where the hydrate plug starts to disintegrate, the pressure will stay at the same level while there still are hydrates in the system. That is because as hydrate "ice" turns into gas, it will expand and fill the volume in the cavity 40. When the pressure sensor 41 again records a falling pressure, this is a sign that the hydrate plug has been completely dissolved.

As shown in FIG. 1, the control unit 15 with the unit may be connected to all parts of the intervention system, such as the Christmas tree 6, the LRP 11 or, via line 23, the PCH 13. This enables all parts of the system to be tested or, alternatively, enables the removal of hydrate plugs from all of the components. The items that can be tested may include, but are not limited to, a downhole safety valve, a crown plug, rams in the LRP, isolation valves, production valves, the pressure control head (PCH) and a grease injection unit.

Figure 4:
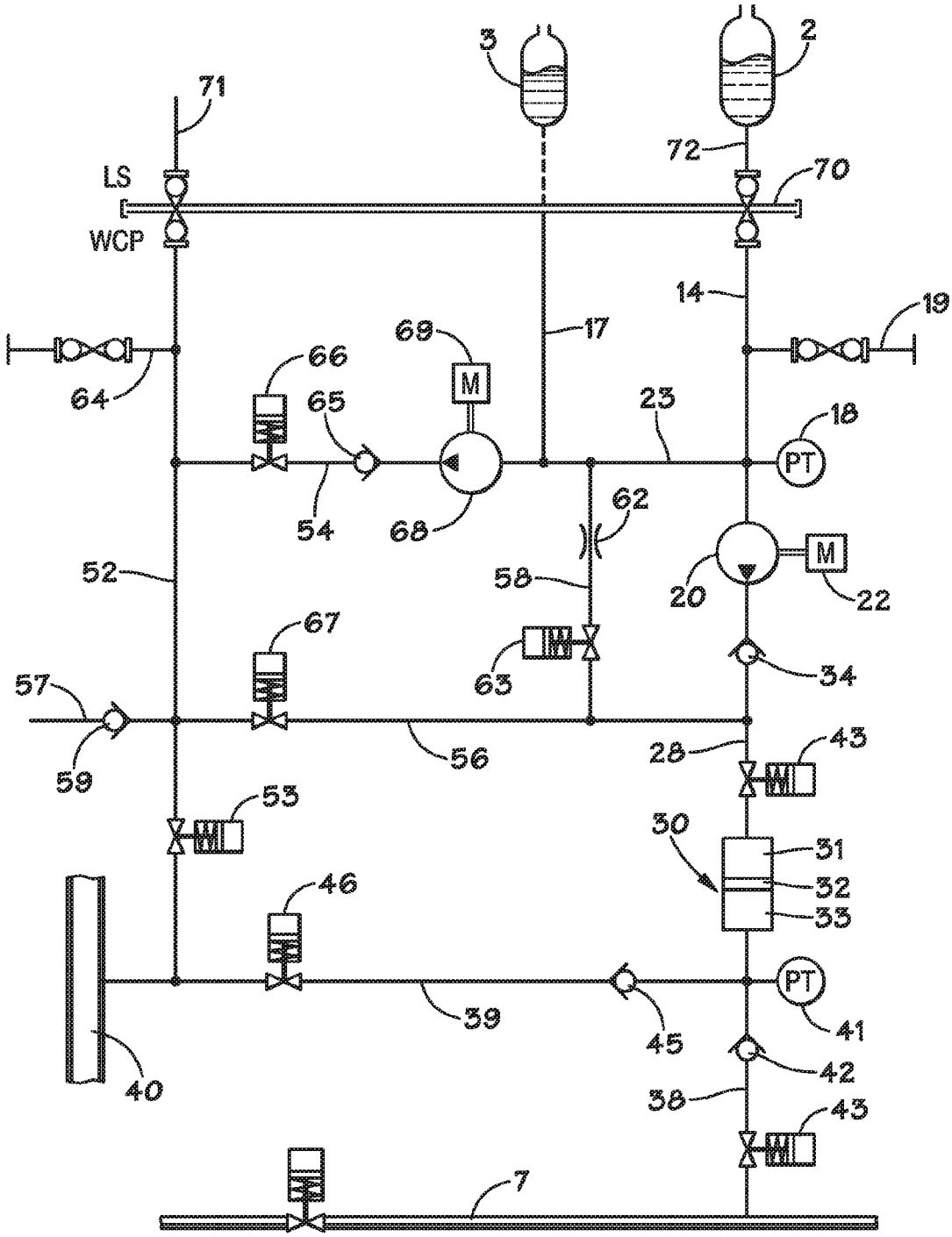
FIG. 4 is a schematic diagram of a chemical injection unit according to another illustrative embodiment disclosed herein.

In an alternative embodiment, the pressure reducing device is combined with a chemical injection system into a compact unit. FIG. 4 shows a diagram of a Chemical Injection and Barrier Test Unit (CIBTU) according to one embodiment disclosed herein.

As previously described, the unit may be operatively connected to all parts of the subsea intervention system. In addition to the connection to the flowline 6 and a cavity 40, the unit has a separate connection line 57 to a well control package (WCP) and to one or more external lines or equipment, represented by lines 71 and 72, as indicated in FIG. 4. These are connected with the module using an interface 70 that is attached to the unit by way of multiple quick connector (MQC) connections 75. This enables fluids from an external source, for example from the umbilical 17, to be introduced into the system. The connection also includes lines for signal and electrical power (not shown). The operative parts of the system (actuators, motors) have connections to a source of power that is not shown but is well known in the art. This may be hydraulic or electrical power, however, such connections have been omitted from the diagram for clarity.

The unit comprises a first fluid line 14 extending between the MQC interface 70 and the inlet of a liquid pump 20 driven by an electric motor 22. The pump 20 is preferably a high capacity, 690 bar electric driven circulation pump. In one illustrative embodiment, the pump 20 may have a capacity of 3.6 $m^3$/h at 500 bar. The pump 20 may be connected directly (not shown) to a topside variable speed drive (VSD) for speed control via 3.3 kV umbilical conductors (typically 100 kW available electric power) supplied through umbilical 17. As will be understood by those skilled in the art after a complete reading of the present application, FIG. 2 depicts a generic system wherein the piston 32 may be driven by any mechanism. In the illustrative example depicted in FIG. 2, the piston 32 is driven by an electrical motor 24 via the mechanical rod 25.

A line 28 extends between the outlet of the pump 20 and the first chamber 31 of the transfer accumulator 30. A one-way valve 34 and an operated valve 36 is included in line 28. The transfer piston accumulator 30 is capable of 690 bar delta pressure in both directions for bleed down of downstream pressure. As explained with reference to FIG. 2, the chamber 33 of the transfer accumulator 30 is connected to the well fluid system, e.g., flow line 7.

A line 52 extends from the interface 70 to connect with the cavity line 39. Line 52 includes an operated valve 53. A first cross line 54 connects line 52 with the output side of pump 68. Line 54 includes the one-way valve 65 and the operated valve 66. The inlet side of the pump 68 is connected via line 23 to line 14. A second cross line 56 connects line 52 with line 28 at a point between the one-way valve 34 and valve 36. Line 56 includes an operated valve 67. Finally, a third cross line 58 connects line 23 with line 56. A pressure reducer 62 and an operated valve 63 are provided in line 58.

The unit can be connected with the well control package (WCP) for injection of chemicals into the well or well intervention system via line 57 that is connected to line 52. It includes a one-way valve 59. A line 64 is also connected with line 52. Line 64 terminates in an ROV hot stab for connecting a jumper to the unit, using an ROV. This enables chemical injection into other parts of the well system that is not reached by the standard connections.

A first bladder tank 2, with a volume of, for instance, 4 $m^3$, is, via interface 70, connected to line 14. In one illustrative embodiment, the tank 2 is a separate retrievable unit so that, when empty, it can be exchanged for a new full tank. The tank 2 normally contains a hydrate inhibitor such as methanol or MEG.

A second bladder tank 3, normally smaller than the first bladder tank 2, for instance with a volume of 1 $m^3$, is, via interface 70, connected to fluid line 17 and 23 before the inlet of pump 68. The second bladder tank 3 may normally contain other chemical fluids (other than MEG) that may be needed during various operations. For example, such other chemical fluids may include grease, scale inhibitors, emulsion dissolvers or other solvents. The second tank 3 may enable chemical injection during the period when the wireline tool string is retrieved to the surface. There may, of course, be more tanks with different chemical fluids as deemed necessary. There may, for example, be provided a "bank" of containers that can be switched at will. Another alternative is to have at least the smaller tank located within the unit, as shown on FIGS. 5-8.

An ROV hot stab 19 is provided for topping up the bladder tanks 2 or 3. The supply of chemicals may be provided via a separate hose from the surface (through umbilical 17) or from an additional retrievable bladder tank (not shown) located subsea and operated by the ROV. For example, a ½"-¾" 10,000 foot chemical hose with an ROV hot stab for direct injection or for topping off the bladder tank 3 may be provided on a separate reel at the surface for deployment when needed. The capacity of the bladder tank 3 is large enough to enable the lubricator volume to be circulated out. Pressure and temperature sensors are provided throughout the unit as necessary. For example, one such sensor, designated 18, is provided in the line 14.

In one illustrative embodiment, the second low capacity chemical electric driven injection pump 68 is a 690 bar rated pump for continuous injection of up to 300 l/h. The pump 68 comprises controls that permit the pump 68 to regulate injection rates down to 5% of full capacity. Flow meters (not shown) may be positioned at various points in the system to verify correct chemical injection rates.

The main components added to the chemical Injection Unit to enable the barrier test functionality described herein are topside chemical tanks and topside chemical injection pumps for topping off the subsea bladder tanks 2,3 via chemical hose. Improved instrumentation and carefully selected injection points may reduce chemical consumption significantly.

According to a first aspect, with reference to FIG. 4, the unit may be used for chemical circulation of the lubricator 12. FIG. 4 depicts an embodiment wherein the piston 32 is driven by liquid from the pump 20. Thus, in the illustrative example depicted in FIG. 4, the pump 20 may be employed to perform the same functions as that of the motor 24 in FIG. 1, i.e., to pump liquid (from tanks 2 or 3) to locations in the LWI stack (57 or 64). The arrangement in FIG. 4 eliminates the need of having a separate driver for the piston 32, i.e., the motor 24, and a separate liquid injection pump to inject fluids into the system.

In some cases, from time to time it may be necessary to circulate out water and/or well fluids from the lubricator 12 to avoid hydrate formation or the release of hydrocarbons to the environment. In such cases, a relatively large amount of chemical is needed and will therefore be drawn from bladder tank 2. Valves 36, 53, 63 and 66 are closed and valve 67 is opened. The chemical fluid from the bladder tank 2 is pumped (using high capacity pump 20) through lines 14, 56 and 57 into the lubricator 12.

According to another aspect, with reference to FIG. 4, the system disclosed herein can provided continuous chemical injection into the lubricator system or into the well system. The fluid may be a treatment fluid, scale inhibitor or grease that is supplied to the PCH 13. The chemical is preferably drawn from bladder tank 3 but, in case of larger amounts, a tank 2 with another chemical fluid may be substituted as desired. In this case, valves 36, 63 and 67 are closed while valve 66 is opened. When pump 68 is started, fluid will flow from bladder tank 3 (or 2 as the case may be) into the well system. By manipulating the various lines, the chemical fluid may be supplied to the PCH 13 (through line 64), the WCP (through line 57) or the cavity 40 (through line 39 and opening valve 53).

Figure 6:
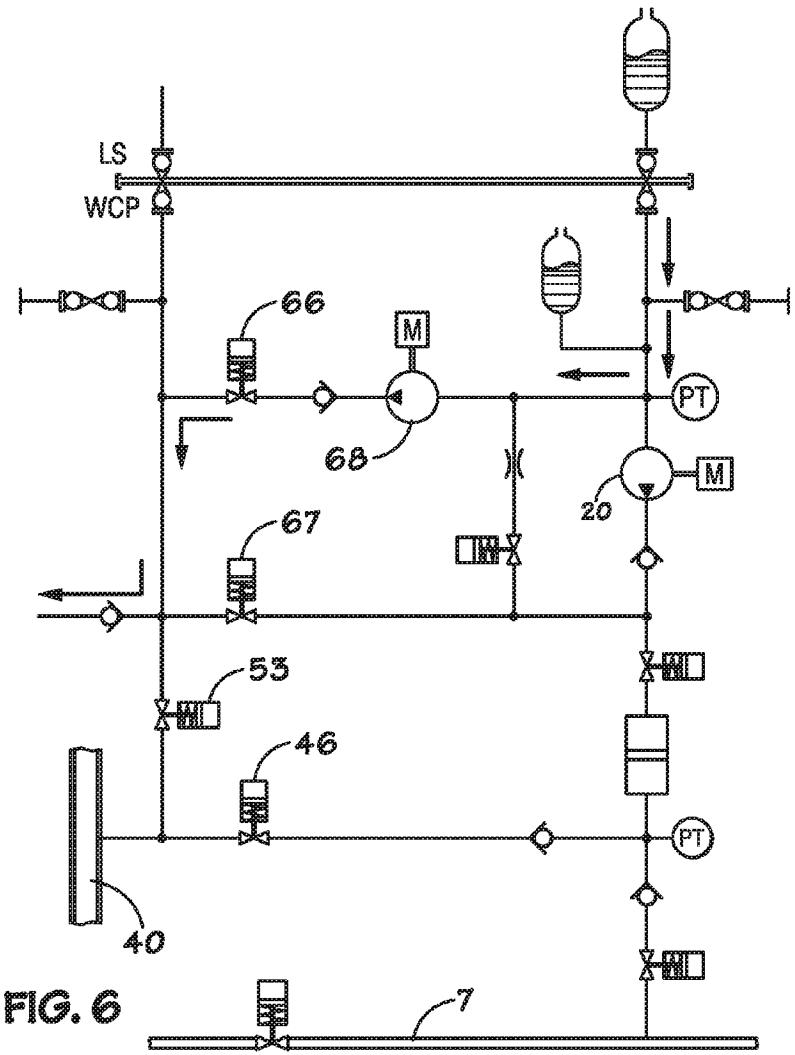
FIGS. 5-8 are diagrams showing the different modes of operation of the systems disclosed herein.
Figure 5:
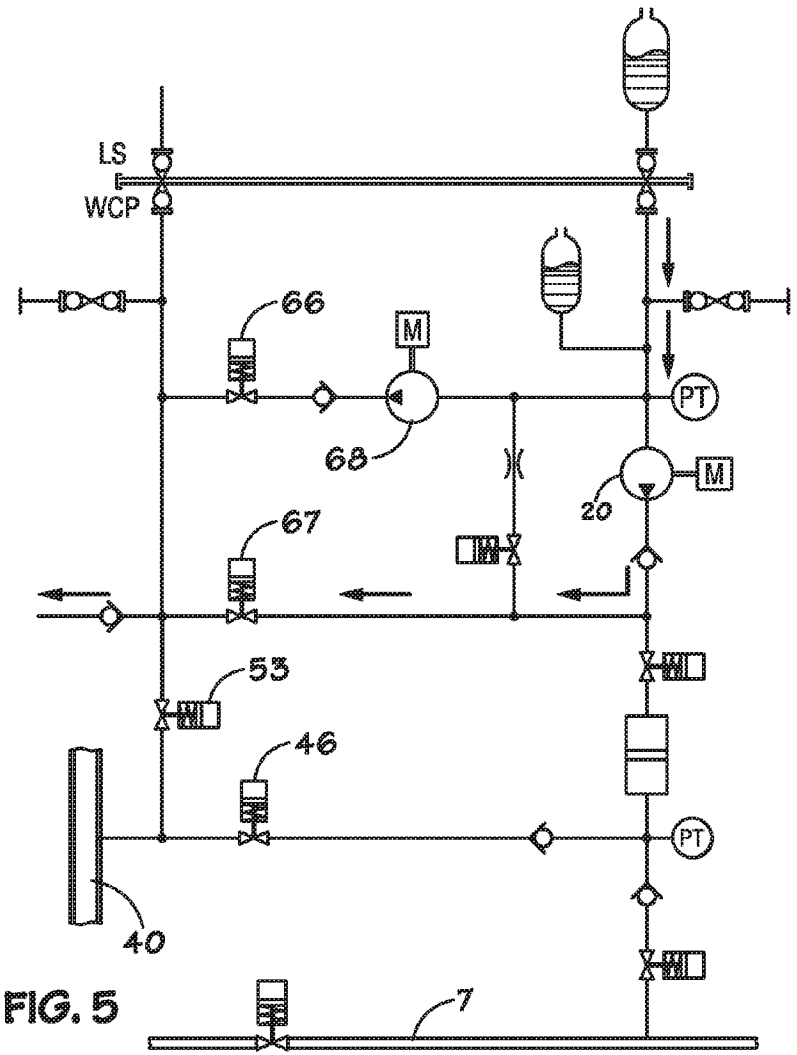

The principles for chemical circulation (low flow rates) and chemical injection (high flow rates) are illustrated in FIGS. 6 and 5, respectively.

According to a third aspect, the system disclosed herein may be used for pressure testing. For example, the unit may be used for main barrier and seal tests. The tests will be performed in the flow direction and would be able to test all parts of the system. The parts that cannot be reached directly may be reached by providing a jumper from the part to the connect up with line 64.

Figure 8:
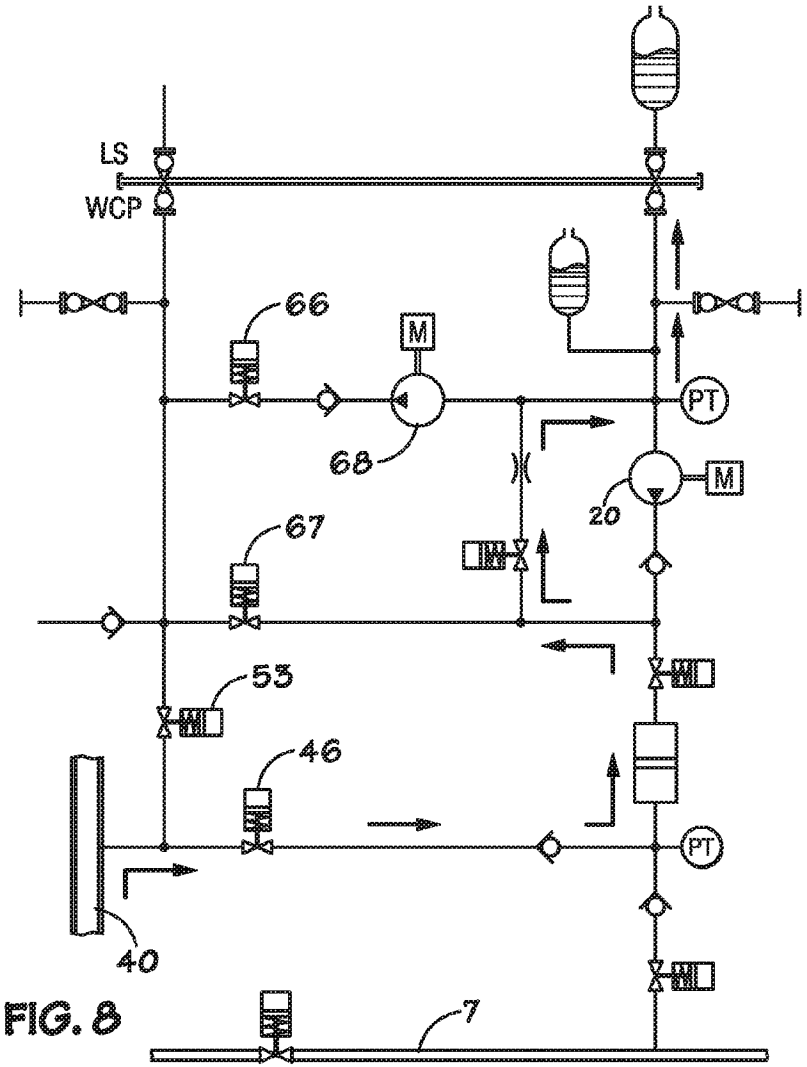
Figure 7:
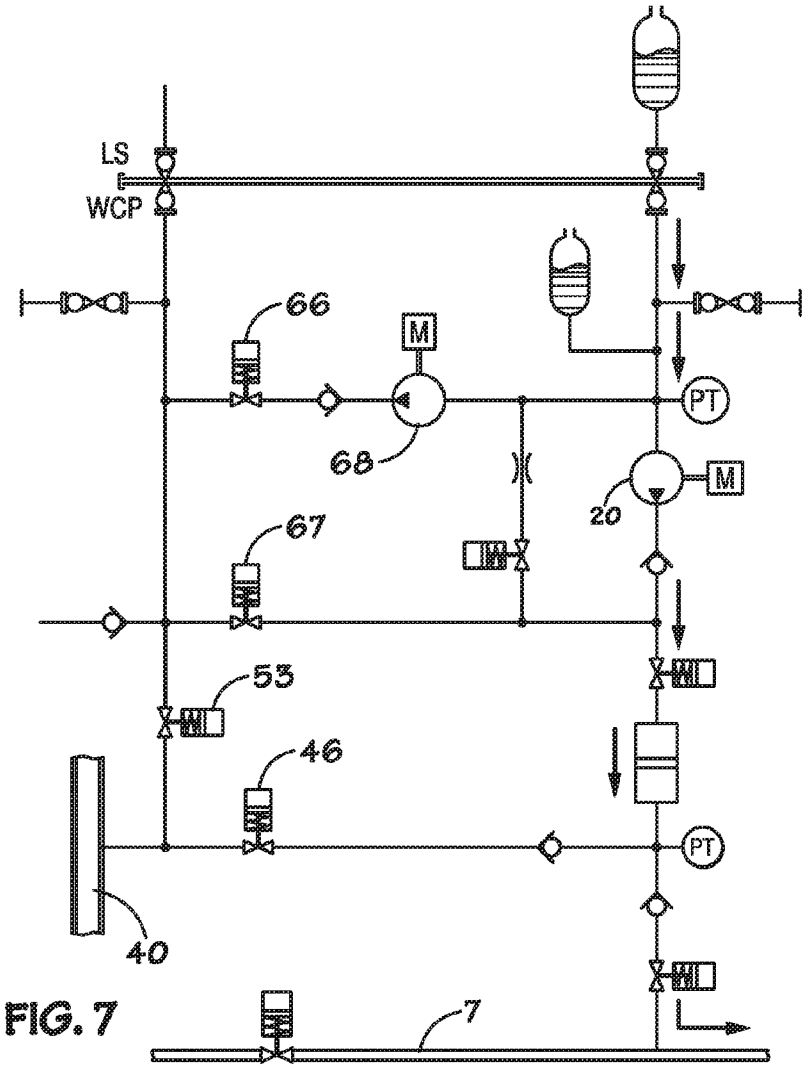

The principles for reducing the pressure for barrier seal tests and barrier tests are illustrated in FIGS. 7 and 8. As described with reference to FIG. 2, the object is to reduce the pressure in cavity 40 to enable a pressure differential to be created. The arrangement allows differential pressure test of barrier valves and plugs without bleeding off well fluids at the downstream pressure side to surface.

The pump 20 is started to push the piston 32 to its lower position. Valves 53, 66 and 67 are closed. Valve 36 is open. Then, the pump 20 is stopped and valve 53 is opened. Because bladder tank 2 is at ambient pressure and cavity 40 is at a (higher) well pressure, the higher pressure in cavity 40 will push the piston 32 upwards, emptying the fluid in chamber 31 to the tank 2. This cycle is repeated until the pressure in cavity 40 has reached ambient pressure. There is now a pressure differential between well pressure and the ambient pressure in the cavity 40. This enables the testing of the seal.

The circulation pump 20 may therefore be indirectly used to pump fluid from the downstream cavity and inject the fluid to a pressurized flowline, as described with relation to FIG. 2. Reciprocating action is controlled by sequentially running pump and open/close chemical bleed back valve. Each stroke will have a significant swept volume and the "dead volume" will be minimal. The circuit will therefore function even with gas. The two strokes in the pumping action are illustrated in FIGS. 7 and 8.

The system may also be used to inject hydrate inhibiting fluid into the flowline 7 if necessary. In this case, valve 36 is closed and valves 67, 53 and 46 are opened. Chemical fluid from tank 2 may now be pumped through lines 14, 56, 52, 39 and 38 into the flowline 7.

The seal testing functions described herein provide verification of correctly mated subsea process connections. This function may be performed as described herein by trapping high pressure hydraulic fluid or chemical and to monitor pressure decay via the relevant subsea pressure transmitter, for example, transmitter 41. In one illustrative embodiment, valves 36 and 46 are closed and valve 67 is open. Fluid can now be pumped through lines 14, 56 and 52 into cavity 40. After the desired pressure has been reached, the pump 20 is stopped, valve 67 is closed, and valve 46 is opened. The pressure in line 39 (and thus cavity 40) is monitored over a period of time by reading off pressure transmitter 41. If the connection is faulty, and fluid leaks into the well, this will show up in a slow reduction in the pressure reading over the desired monitoring time or period. In this way, the pressure decay can be monitored. A seal may be declared as faulty if the monitored pressure decays beyond acceptable limits over a set period of time, or it may be declared faulty if the pressure decays by any amount over the monitored time period. Alternatively, the valve 43 can also be opened and the rate of bleed-off (as calculated or observed from the readings of the pressure transmitter 41) to the flowline 7 can be measured or determined.

The benefit of the invention is that it complements and improves pressure testing safety associated with the "no hydrocarbons to surface" philosophy used elsewhere (such as the lubricator circulation patent WO0125593).

The invention makes it possible to flush all kinds of fluids, such as hydrocarbons, hydrate inhibitors (MEG) and seawater.

It also makes it possible to bleed off parts of the system having pressure lower than the well pressure or flowline pressure, such as the annulus. By using the invention, annulus pressure can be bled to the flowline.

The items that can be tested may include, but are not limited to, a downhole safety valve, a crown plug, rams in the LRP, isolation valves, production valves, the pressure control head (PCH) and the grease injection unit.

With the present invention, it will be possible to reduce the pressure at a location in the subsea system. The ability to reduce the pressure achieves two purposes. On the one hand, it will enable a testing of the integrity of seals so that it can be ascertained they are working properly. On the other hand, it will enable hydrates accumulated into a cavity to be "boiled" off. The formation of hydrates is very dependent upon the pressure and temperature. A lowering of the temperature, as for instance when hydrocarbons come into contact with the cooler surrounding seawater, will lead to hydrate formation at a set pressure. Lowering the pressure and/or increasing the temperature allows the hydrates to melt and convert back to hydrocarbon gas. The formation of hydrates may block off a cavity or a pipe and, at a remote seabed location, there can be considerable difficulties in removing this hydrate plug.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A method of reducing pressure in a subsea device, the method comprising:

transferring fluid within a first cavity of the subsea device to an accumulator to reduce a pressure within said first cavity;

increasing a pressure of said fluid within said accumulator; and after increasing the pressure of the fluid within the accumulator, transferring at least some of the fluid in the accumulator into a production flowline associated with the subsea device, wherein the production flowline is at a higher pressure than said first cavity.

2. The method of claim 1, wherein said subsea device is a subsea Christmas tree having said first cavity defined therein.

3. The method of claim 1, wherein increasing a pressure of said fluid within said accumulator comprises actuating a piston to increase said pressure of said fluid within said accumulator.

4. The method of claim 3, wherein actuating said piston comprises actuating an electric motor that is operatively coupled to said piston.

5. The method of claim 3, wherein actuating said piston comprises actuating a pump that is in fluid communication with structure containing said piston so as to cause said piston to move.

6. The method of claim 1, further comprising monitoring a pressure within the first cavity.

7. A device for reducing a pressure within a subsea device, comprising:

a transfer accumulator comprising a piston, said transfer accumulator being in fluid communication with a first cavity of the subsea device and a production flowline associated with the subsea device;

at least one first valve positioned between said first cavity and said transfer accumulator, said at least one first valve adapted to permit fluid flow only from said first cavity to said transfer accumulator; and at least one second valve positioned between said transfer accumulator and said flowline, said at least one second valve adapted to permit fluid flow only from said transfer accumulator to said flowline.

8. The device of claim 7, wherein said subsea device is a Christmas tree having said first cavity defined therein.

9. The device of claim 7, wherein said at least one first valve comprises a one-way check valve.

10. The device of claim 9, wherein said at least one first valve comprises a control valve.

11. The device of claim 10, wherein said at least one second valve comprises a one-way check valve.

12. The device of claim 11, wherein said at least one second valve comprises a control valve.

13. The device of claim 7, wherein said first cavity is adapted to be at a lower pressure than said flowline.

14. The device of claim 7, further comprising an electric motor that is operatively coupled to said piston, said motor, when actuated, adapted to cause said piston to move.

15. The device of claim 7, further comprising a pump that is in fluid communication with said transfer accumulator, said pump, when actuated, adapted to introduce a fluid into said transfer accumulator and cause said piston to move.

* * * * *